US012584267B2

(12) United States Patent
Ceraudo

(10) Patent No.: US 12,584,267 B2
(45) Date of Patent: Mar. 24, 2026

(54) IRONING BOARD INTENDED FOR USE WITH A STEAM-TYPE IRONING DEVICE

(71) Applicant: INPRO B.V., Oisterwijk (NL)

(72) Inventor: Rosario Ceraudo, Rumont (FR)

(73) Assignee: Inpro B.V., Oisterwijk (NL)

( * ) Notice: Subject to any disclaimer, the term of this patent is extended or adjusted under 35 U.S.C. 154(b) by 0 days.

(21) Appl. No.: 18/534,891

(22) Filed: Dec. 11, 2023

(65) Prior Publication Data

US 2024/0191425 A1 Jun. 13, 2024

(30) Foreign Application Priority Data

Dec. 12, 2022 (FR) ..... 2213170

(51) Int. Cl.
*D06F 81/04* (2006.01)
*D06F 81/00* (2006.01)
*D06F 83/00* (2006.01)

(52) U.S. Cl.
CPC ..... *D06F 81/04* (2013.01); *D06F 81/003* (2013.01); *D06F 83/00* (2013.01)

(58) Field of Classification Search
CPC ..... D06F 81/04; D06F 81/003; D06F 83/00
See application file for complete search history.

(56) References Cited

U.S. PATENT DOCUMENTS

| | | | | | |
|---|---|---|---|---|---|
| 2,776,506 | A * | 1/1957 | Scherer | D06F 83/00 | 38/140 |
| 3,007,267 | A * | 11/1961 | Goldsmith | D06F 83/00 | 38/140 |
| 4,360,984 | A * | 11/1982 | Ruttenberg | D06F 83/00 | 428/317.1 |
| 4,903,421 | A * | 2/1990 | Saito | D06F 81/10 | 38/103 |
| 5,830,548 | A * | 11/1998 | Andersen | C04B 28/04 | 428/152 |
| 6,349,490 | B1 | 2/2002 | Gross et al. | | |
| 2019/0292717 | A1 * | 9/2019 | Alavian | D06F 83/00 | |
| 2020/0071876 | A1 | 3/2020 | Ceraudo | | |

FOREIGN PATENT DOCUMENTS

| | | | | |
|---|---|---|---|---|
| EP | 1002895 | 12/2006 | | |
| WO | 2013038317 | 3/2013 | | |
| WO | WO-2019002592 A1 * | 1/2019 | | D06F 83/00 |

* cited by examiner

*Primary Examiner* — Ismael Izaguirre
(74) *Attorney, Agent, or Firm* — Renner, Kenner, Greive, Bobak, Taylor & Weber

(57) ABSTRACT

An ironing table intended for use with a steam-type ironing device includes at least one leg, in particular two legs (1, 2) articulated with respect to one another, supporting a board (4) covered with an outer cover (12), wherein: the board (4) is made of a wooden material; and an intermediate layer (15) of plastics material is arranged between the board (4) made of wooden material and the outer cover (12), the layer (15) of plastics material including, on the opposite side to the leg(s), a metallising layer (16), particularly an aluminium layer.

18 Claims, 5 Drawing Sheets

[Fig. 1]
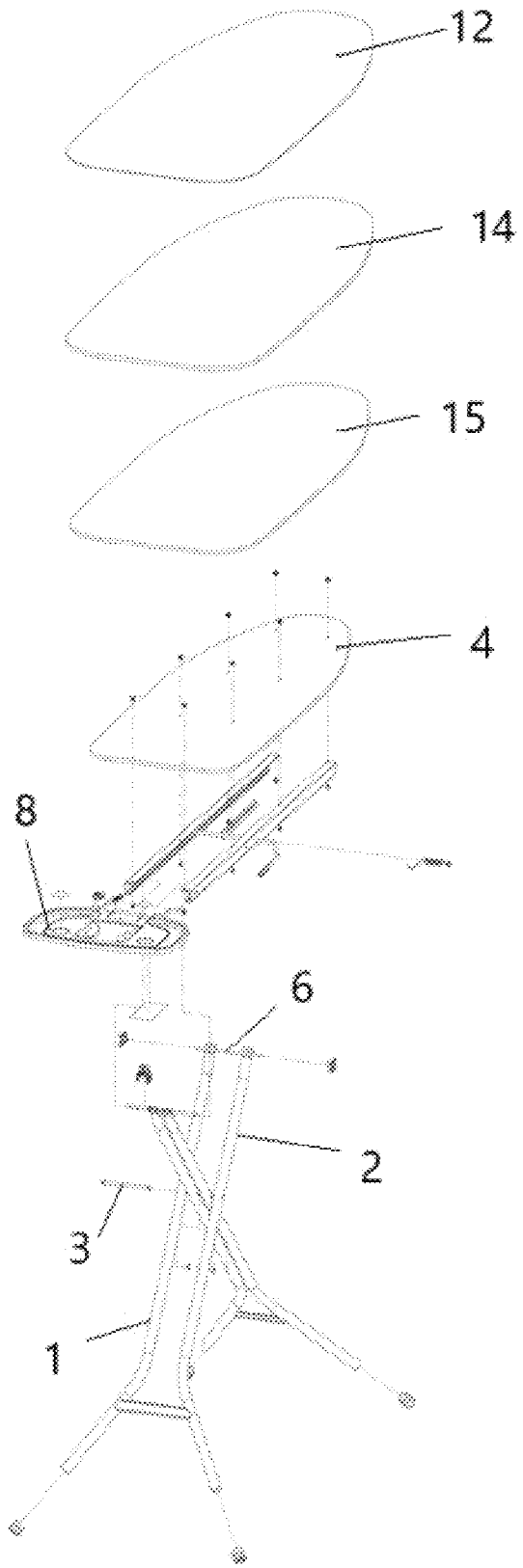

[Fig. 2]
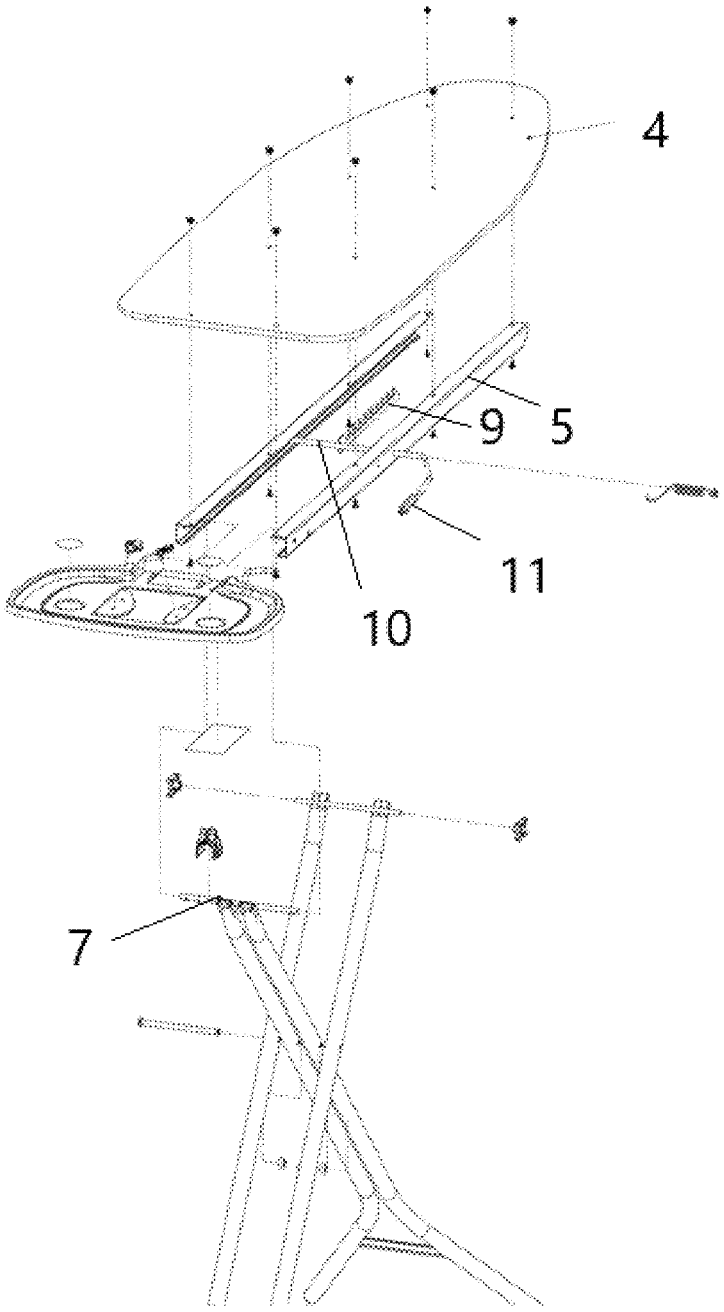

[Fig. 3]
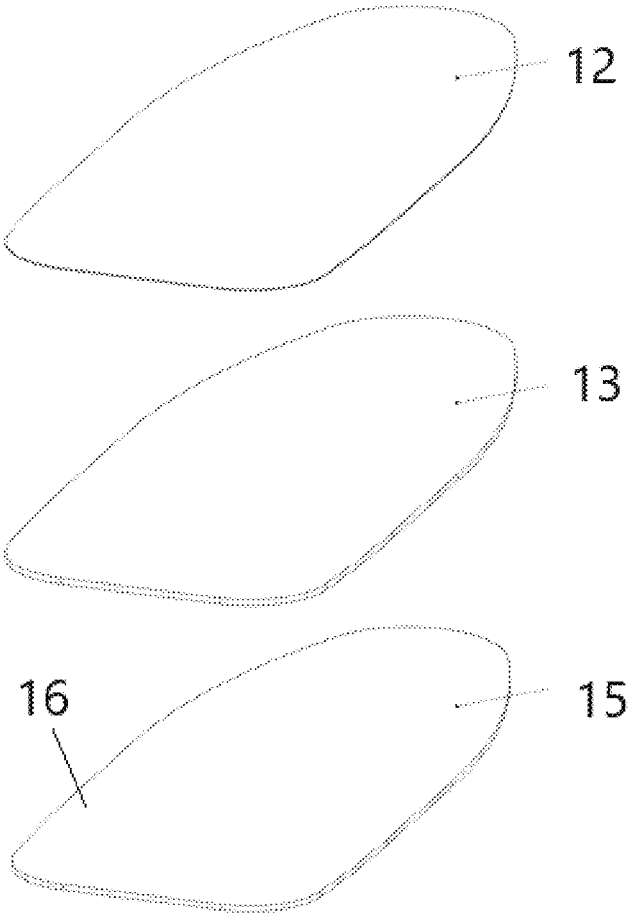

[Fig. 4]
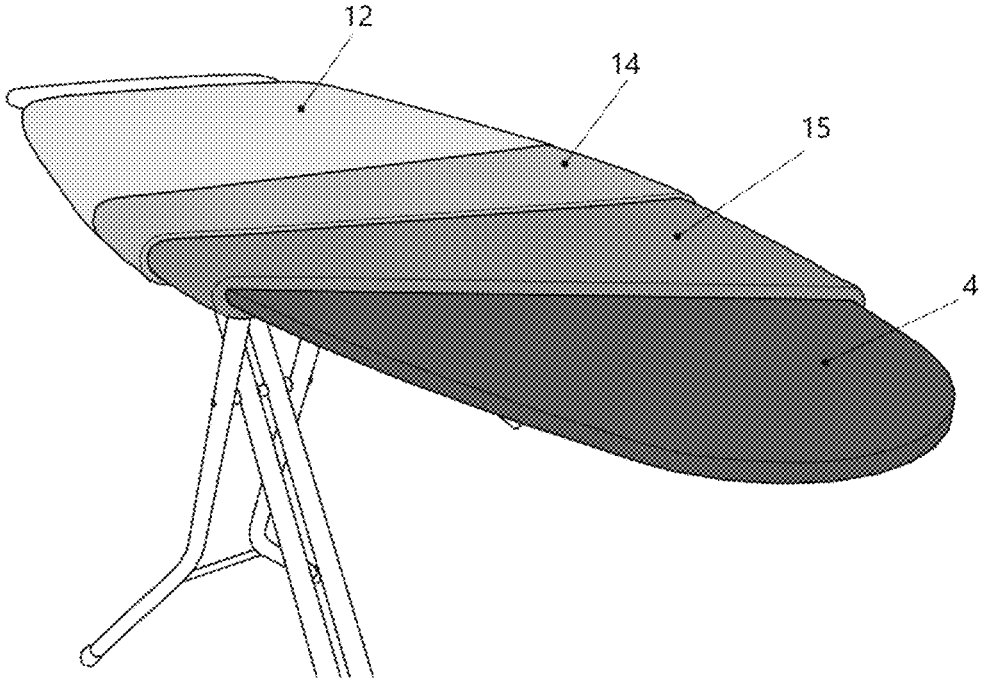
[Fig. 5]
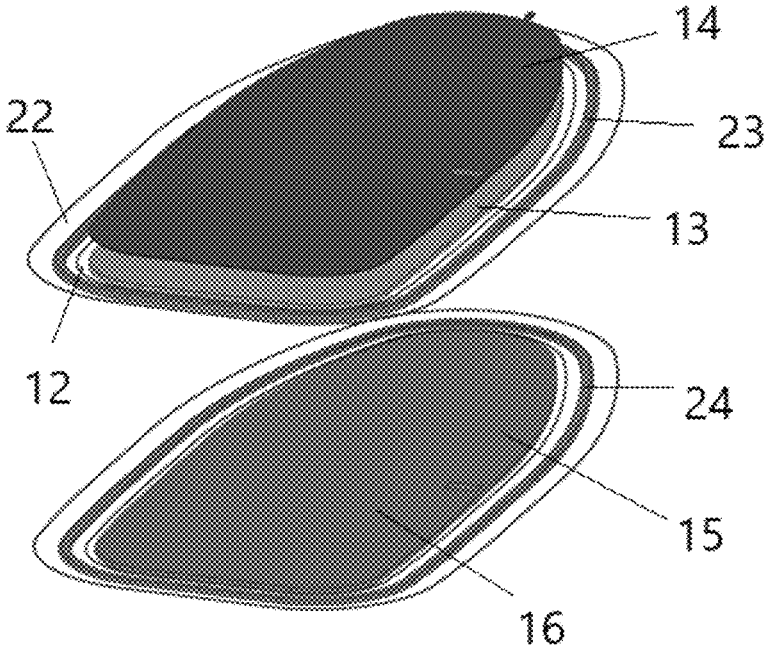

[Fig. 6]
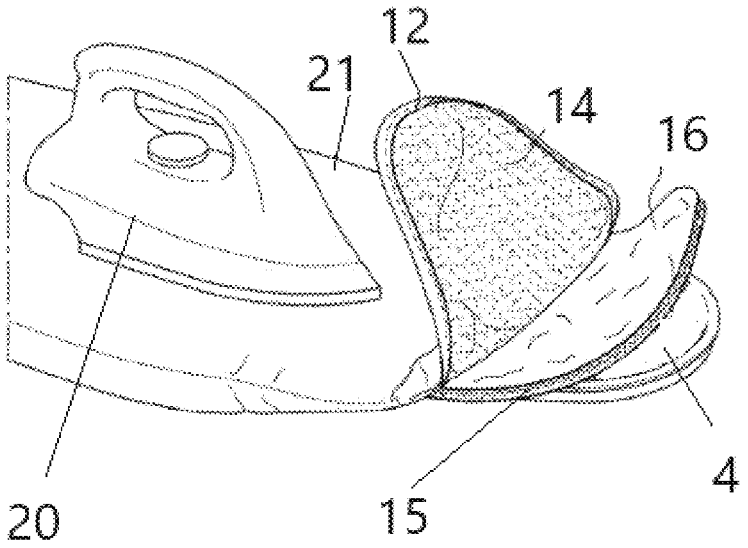
[Fig. 7]
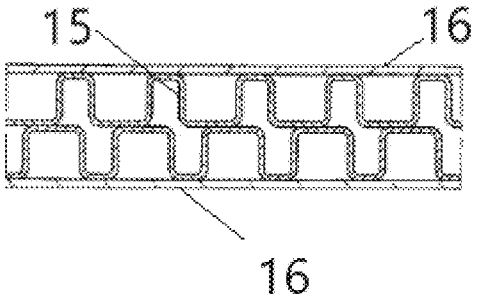

IRONING BOARD INTENDED FOR USE WITH A STEAM-TYPE IRONING DEVICE

The present invention relates to an ironing table intended for use with a steam-type ironing device, particularly a steam iron, a steam generator, a steam system or similar, and an assembly comprising an ironing table of this type and a steam-type ironing device.

Traditionally, ironing tables intended for use with a steam device are manufactured comprising a board made of metallic material, preferably perforated to allow steam to pass through the board and not stagnate in the board. These ironing tables with a metal board have disadvantages such as being complicated to manufacture and they deteriorate rapidly, particularly due to corrosion, and they also cause pools of water on the floor beneath the ironing table.

In the case of ironing tables comprising boards made of wooden material, for example plywood, they are not compatible with water vapour which tends to damage wood, in particular causing the layers of the wood to become delaminated.

The object of the present invention is to overcome the disadvantages of the prior art by proposing an ironing table that is suitable for use with steam ironing devices, has a long service life and is easy to manufacture.

According to the invention, an ironing table, particularly intended for use with a steam ironing device, comprising at least one leg, in particular two legs articulated with respect to one another, supporting a board covered with an outer covering, in particular a textile material, for example cotton, is characterised in that:

- the board is made of a wooden material, for example plywood, chipboard, oriented strand board or OSB, MDF (medium-density fibreboard) or other material; and
- an intermediate layer of plastics material, particularly a film made of plastics material, particularly thermoplastic material, is arranged between the board made of wooden material and the covering, said layer of plastics material being substantially impervious to water vapour.

According to a preferred embodiment of the invention, the layer of plastics material, particularly the film of plastic material, in particular thermoplastic material, is in contact with the upper face on the opposite side to the leg or legs, of the board.

Preferably, the layer, in particular the film, made of plastics material, in particular thermoplastic material, is coated, on the side opposite the leg(s), with a metallising layer, in particular an aluminium layer.

According to a preferred embodiment of the invention, at least one flexible element made of a thermally insulating material is arranged between the layer of plastics material and the outer covering.

Preferably, the flexible insulating element comprises at least one sheet of cellular material or foam and/or at least one fleece or felt fabric.

Preferably, the flexible insulating element comprises at least one layer of cellular material or foam and at least one fleece or felt fabric, the layer of cellular material or foam being arranged on the side of the outer covering, in particular in contact with the lower face of said covering.

According to a preferred embodiment of the invention, the plastics material layer is a bubble film, i.e. a film consisting of a base film and domes originating from one face of the base film, each defining a small bubble or vapour-tight space in which air is trapped, the bubbles preferably being arranged in rows and columns.

Preferably, the face of the base film on the opposite side to the domes is covered with a metallising layer or film, in particular aluminium.

In particular, a metallised, particularly aluminised film, for example an aluminised BOPP film, is laminated on the face of the base film on the opposite side to the domes.

According to a preferred embodiment, the layer of plastics material comprises a bubble film, where the face opposite the bubbles is metallised, particularly aluminised, the bubble film having been folded over on itself, domes against domes, both folded parts being attached to one another, in particular welded or glued or similar.

According to a particularly favourable embodiment, which constitutes an invention in its own right, independently of the aspects of the invention referred to above, but which can favourably be implemented with each of these aspects, the outer covering, the layer of cellular material or foam and the fleece or felt are joined together, particularly by calendering, after singeing, particularly on both faces thereof, of the layer of cellular material to soften it and thus allow the three elements to be joined after calendering so as to form a single element forming a cover.

As such, the present invention also relates to a cover intended to cover an ironing table comprising, in succession, a textile covering, in particular cotton, a sheet of cellular material or foam and a fleece or felt fabric, said three elements being joined together by calendering, after singeing, particularly on both faces thereof, of the layer of cellular material to soften it and thus allow the three elements to be joined after calendering.

The present invention also relates to an ironing assembly comprising an ironing board according to the invention and a steam-type ironing device, in particular a steam iron, a steam generator, a steam system or similar.

The present invention also relates to the use of a cover intended to cover an ironing table comprising, in succession, a textile covering, in particular cotton, a sheet of cellular material or foam and a fleece or felt fabric, said three elements being joined together by calendering, after singeing, particularly on both faces thereof, of the layer of cellular material to soften it and thus allow the three elements to be joined after calendering to cover a board of an ironing table, a film made of plastics material, particularly a bubble film, being trapped between the cover and the board.

The present invention also relates to a manufacturing process for a cover intended to cover an ironing table, particularly an ironing table comprising a board made of a wooden material, still more preferably an ironing table according to the invention, comprising steps in which:

- A width or strip of a textile fabric is unrolled from a roll of said textile fabric, particularly cotton;
- A strip or width of a lap of cellular material or foam is unrolled from a roll of said lap of cellular material or foam, the strip or width being identical to the strip or width of the textile fabric;
- A strip or width of a fleece or felt fabric is unrolled from a roll of said fleece or felt fabric, the strip or width being identical to the strip or width of the textile fabric and the lap of cellular material;
- The lap of cellular material is softened, particularly by singeing, in particular on both faces thereof,
- A stack of three strips or widths together is passed, with the softened lap arranged between the textile fabric and the fleece or felt, between two pressing elements, for example two rollers, for calendering thereof and to achieve joining in the form of a laminate of the same strip or width comprising the textile fabric, the lap of cellular material and the fleece or felt.

A covering element which is particularly well suited to use with a board made of wooden material, particularly in combination with a layer of plastics material that is impervious to water vapour, is thus obtained.

Preferably, after calendering, the laminate is cut around a pattern in the shape of the contour of a board for which the intention is to produce a covering sheet plus a peripheral selvedge, then the cut laminate is provided with means to movably attach the laminate to said ironing table board, in particular in the region of the peripheral edge of the laminate, for example by sewing along the entire periphery of the cut laminate a peripheral ring in which a cord extends, both ends of the cord leaving the ring via an opening formed in said ring to thus allow them to be tied together to pull the covering tightly against the board from beneath said board, or an elastic thread or ribbon received in the peripheral ring, allowing the textile fabric to pass over the edge of the board so as to then be supported elastically against the lower face of the board or an elastic thread or ribbon sewn along the periphery of the textile fabric.

According to a preferred embodiment, the laminate is folded over on itself, after calendering, several times before cutting around the pattern to thus obtain a plurality of cut laminates, to each of which fixing means are then added.

By way of example, preferred embodiments of the invention will now be described with reference to the drawings in which:

FIG. 1 is an exploded, perspective view of an ironing table in the deployed state according to an embodiment of the invention;

FIG. 2 is a larger-scale view of the lower part of the table in FIG. 1, not including those parts covering the board of the table in FIG. 1;

FIG. 3 is a larger-scale view of the upper part of another embodiment of a table according to the invention, comprising only those parts covering the board, the table, in respect of its lower part, being identical to the table in FIG. 1;

FIG. 4 is a perspective view of the table from FIG. 1 in the assembled state, some parts of the table having been removed to aid comprehension;

FIG. 5 is a perspective view of an upper part of yet another embodiment of a table according to the invention, the lower part of the table being identical to that of the table in FIG. 1;

FIG. 6 is a representation of part of an assembly according to the invention, comprising, on the one hand, a steam iron and, on the other hand, an upper part of a table according to yet another embodiment of the invention; and FIG. 7 is a sectional view of the layer of plastics material, in the form of a bubble film folded over on itself, of the embodiment in FIG. 6.

The figures show ironing tables according to a plurality of embodiments of the invention.

In the conventional manner, the ironing table comprises two legs 1 and 2, assembled such that they are articulated against one another following an axis 3 and supporting a board 4 by means of two longitudinal metal rails 5 fixed by screws to the lower face of the board 4, the upper end of one 1 of the legs comprising a rod 6 fitted such that it slides along the rails 5, whereas the end 7 of the other leg 2 is pivotally attached to the board 4, in particular by means of the two rails 5.

An iron rest 8 is attached to the board 4 on the side thereof, particularly by screws attaching lugs originating from the iron rest to the rails 5, which are themselves attached to the lower face of the board 4.

A rack 9, comprising teeth facing the board 4, is pivotally mounted with respect to an axis 10 fixed to the rails 5, a lever 11 allowing the user to pivot the rack to allow the height of the board to be adjusted in the deployed position of the table by choosing the two teeth of the rack between which the rod 6 is received.

Teeth that have a large fixing profile can be provided, particularly covering over half the rod 6, so as, in addition, to ensure that the rack is locked and cannot be unlocked unless the legs 1 and/or 2 are lifted off the ground, this mechanism traditionally being referred to as a "child safety lock". However, this child safety mechanism can be omitted without departing from the scope of the invention.

The board 4 is made of a wooden material, in particular plywood, chipboard, oriented strand board or OSB, MDF (medium-density fibreboard), in particular OSB.

The board 4 is covered in its entirety by a bubble film 15, the upper face of which, opposite the board, comprises a metallising layer 16, particularly aluminium. The bubble film comprises an elastic bias binding 24 sewn around its periphery to hold it tightly in position around the wooden board 4, against the upper face of said board.

An outer covering 12 made of textile material, particularly cotton, then covers the entire board 4 made of wooden material by means of a drawstring cord passing in a ring 23 formed on a hem 22 sewn around the periphery of the covering 12, the two ends of the cord leaving the ring via an opening formed therein to thus allow them to be tied together to pull the covering tightly against the board from beneath said board. Instead of such a cord, an elastic thread or ribbon received in the peripheral ring could also be provided, allowing the covering to pass over the edge of the board 4 to then be supported elastically against the lower face of the board. It would also be conceivable, as in the case of the bubble film, to sew the thread or ribbon, such as elastic bias binding 24, along the periphery of the hem of the cover and thus omit the peripheral ring.

In the embodiment in FIGS. 1 and 4, a thermally insulating flexible element in the form of a fleece or felt fabric 14 is provided between the outer covering 12 made of textile material, particularly cotton, and the bubble film 15 in contact with the upper face of the board 4.

According to another embodiment shown in FIG. 3, a thermally insulating flexible element in the form of a sheet 13 of cellular material or foam is arranged between the covering 12 and the bubble film 15 in contact with the upper face of the board 4.

According to yet another embodiment shown in FIG. 5, a thermally insulating flexible element in the form of both a sheet 13 of cellular material or foam and a fleece or felt fabric 14 is arranged between the covering 12 and the bubble film 15. In FIG. 5, the sheet 13 and the fabric 14 are shown on top of the covering 12 so that they are visible. However, in use, the assembly 12, 13, 14 shown is turned in the opposite direction to that shown on the figure so that it is positioned on the board with the fabric 14 in contact with the metallising layer 16 deposited on the film 15, the covering 12 forming the outermost part, the sheet 13 and the fabric 14 being trapped between the covering 12 and the board 4 covered with the film 15, which is itself covered by the metallising layer 16.

Thus, the stack on top of the board 4 is comprised, starting from the board 4, of the bubble film 15, in contact with the upper surface of the board 4, the metallising layer 16 joined to the bubble film 15, the fleece or felt fabric 14, the layer 13 of cellular material or foam, and finally the cotton covering 12, the upper surface of which forms the upper ironing surface of the ironing table.

According to the embodiment shown in FIG. 5, the covering 12 and the flexible thermally insulating element in the form of the sheet 13 of cellular material or foam and the fleece or felt fabric 14 are joined together to form a single covering element forming an ironing table cover, this joining being achievable in particular by hot calendering, thermowelding, sewing, ultrasonic welding or any other method. In particular, to manufacture the cover comprising three elements 12, 13 and 14, a width or strip of a textile fabric 12 can be unrolled from a roll of said textile fabric 12, particularly cotton, a strip or width of a lap 13 of cellular material or foam can be unrolled from a roll of said lap, the strip or width being identical to that of the textile fabric, a strip or width of a fleece or felt fabric 14 can be unrolled from a roll of said fabric or felt, the strip or width being identical to that of the textile fabric and the lap of cellular material, the lap 13 of cellular material can be softened, in particular by singeing, particularly on both faces thereof, a stack of the three strips or widths together, with the softened lap arranged between the textile fabric and the fleece or felt, can be passed between two pressing elements, for example two rollers, in order to calender it and achieve joining in the form of a laminate of the same strip or width made up of the textile fabric, the lap of cellular material and the fleece or felt. Then, after calendering, the laminate is cut around a pattern in the shape of the contour of a board for which the intention is to produce a covering cover plus a peripheral selvedge, then the cut laminate is provided with means to movably attach the laminate to said ironing table board, in particular in the region of the peripheral edge of the laminate, for example by sewing along the entire periphery of the cut laminate a hem 22 comprising a peripheral ring 23 in which a cord extends, both ends of the cord leaving the ring via an opening formed in said ring to thus allow them to be tied together to pull the covering tightly against the board from beneath said board. Instead of a cord, an elastic thread or ribbon received in the peripheral ring of the hem may be provided, allowing the textile fabric to pass over the edge of the board to then be supported elastically against the lower face of the board. An elastic thread or ribbon could also be sewn on the hem 22, which is itself sewn to the periphery of the laminate.

However, this arrangement, although it is very favourable, is merely optional and the present invention is not restricted thereto, the elements being able to be independent from one another, the sheet 13 and the fabric 14 being positioned on the bubble film 15, then trapped by positioning the outer covering 12 around the assembly of the board 4, bubble film 15 with metallising layer, fleece 14 and cellular material or foam 13. Moreover, although this arrangement is favourable, it is also possible to merely provide the sheet 13 of cellular material or foam or only the fleece or felt fabric 14 without departing from the scope of the invention.

The insulating flexible element in the form of the sheet 13 of cellular material or foam and/or the fleece or felt fabric 14 serves to protect the bubble film 15. The bubble film 15 is a traditional bubble film made up of a number of domes, each defining a small bubble or airtight space in which air is trapped. The bubbles are arranged in rows and columns, each model having a diameter ranging between 5 and 15 mm, in particular equal to 10 mm. The number of bubbles per square metre may, for example, be 17,200.

FIG. 6 shows an assembly according to the invention, comprising, on the one hand, a steam iron 20 and, on the other hand, a cover 21, consisting of a covering 12 and a thermally insulating flexible element in the form of a sheet 13 of cellular material or foam (not visible on FIG. 6) and a fleece or felt fabric 14 joined to one another by calendering, after singeing the cellular sheet to soften it and thus allow the two elements to be joined together after calendering, the cover 21 then covering a bubble film 15 with a metallising upper layer 16, the bubble film 15 being trapped between the cover 21 and the board 4 of the table.

FIG. 7 shows a sectional view of the bubble film 15 from FIG. 6. The bubble film 15 comprises, on one of its faces, opposite the domes, a metallising layer 16. The bubble film 15 is folded over on itself such that the metallising layer forms the two upper and lower faces of the folded bubble film 15, the bubbles of said bubble film 15 then being sandwiched between the two upper and lower metallising layers, the lower metallised layer then being in contact with the board, whereas the upper metallised layer is in contact with the fleece fabric or the layer of cellular material or foam, depending on the embodiment. Preferably, the domes or bubbles of the two folded parts are attached to one another, in particular welded, glued or similar.

The bubble film material may, in particular, be LDPE (low-density polyethylene), HDPE (high-density polyethylene), LLDPE (linear low-density polyethylene), Resy (recycled materials) or a blend of these materials, in particular a blend of LDPE 70%/HDPE 10%/LLDPE 10%/Resy 10%. The thickness of the bubble film may be selected between 1 and 10 mm, in particular between 2 and 5 mm, for example 3.2 mm.

The bubble film has been aluminised by depositing a film or a layer of aluminium, where said deposition can take place by coating, lamination, stratification or another similar process.

For example, the aluminium film or layer may be a co-extruded metallised BOPP (biaxially oriented polypropylene) film, laminated on one face of the bubble film and having an aluminium thickness of between 0.01 mm and 0.02 mm, in particular equal to 0.015 mm and a plastics material ranging between 100 and 200 g/m2, in particular equal to 110.4 g/m2, i.e. a plastics material thickness ranging between approximately 0.1 mm and 0.2 mm.

The layer of cellular material or foam may in particular be made of polyurethane (PU), in particular with a surface density ranging between 18 $g/m^2$ and 45 $g/m^2$, with a thickness between 1.5 and 2.5 mm, for example 1.8 mm, if used in combination with another flexible insulating element, for example a fleece or felt, and a surface density ranging between 50 $g/m^2$ and 250 $g/m^2$, with a thickness between 5 mm and 10 mm if used in isolation to form the insulating flexible element.

The fleece or felt layer, particularly made of wool or polyester, may have a surface density ranging between 150 $g/m^2$ and 300 $g/m^2$.

The steam ironing device may be defined by the fact that it comprises a water tank and heating means to vaporise this water and means to project this vapour with a pressure of at least 2 bar, preferably at least 3.5 bar, particularly between 3.5 bar and 10 bar, the steam flow preferably being at least 40 g/min, particularly at least 50 g/min, preferably at least 100 g/min, in particular between 200 g/min and 500 g/min.

According to the invention, the material of the layer of plastics material is substantially impervious to water vapour.

According to the invention, a flexible element is understood to mean an element that can easily be folded and folded again, without it breaking or experiencing damage, in particular an element that, when it is held simultaneously at two different locations by the hands of a person of moderate strength, can be deformed, particularly by folding, and can then resume the shape it was in before it was deformed, in particular folded.

What is claimed is:

1. An ironing table comprising at least one leg, in particular two legs (1, 2) articulated with respect to one another, supporting a board (4) covered with an outer covering (12), characterised in that:

the board (4) is made of a wooden material;

an intermediate layer (15) of plastics material, which is substantially impervious to water vapour, is arranged between the board (4) made of wooden material and the outer covering (12); and the layer (15) of plastics material (15) comprising, on the opposite side to the leg(s), a metallising layer (16).

2. The ironing table according to claim 1, characterised in that the layer of plastics material is a bubble film, i.e. a film consisting of a base film and domes originating from one face of the base film, each defining a small bubble or vapour-tight space in which air is trapped, the face of the base film on the opposite side to the domes being covered with a metallising layer or film.

3. The ironing table according to claim 2, characterised in that a metallised, film, is laminated on the face of the base film on the opposite side to the domes.

4. The ironing table according to claim 2, characterised in that the layer of plastics material comprises a bubble film, where the face opposite the bubbles is metallised the bubble film having been folded over on itself, domes against domes.

5. The ironing table according to claim 4, characterised in that the two folded parts are attached to one another.

6. The ironing table according to claim 1, characterised in that the layer (15) of plastics material is in contact with the face of the board (4) which is on the opposite side to the leg(s) or upper face of the board.

7. The ironing table according to claim 1, characterised in that at least one flexible element (13; 14; 13,14) made of a thermally insulating material is arranged between the layer (15) of plastics material and the outer covering (12).

8. The ironing table according to claim 7, characterised in that the flexible insulating element (13; 14; 13,14) comprises at least one sheet (13) of cellular material or foam and/or at least one fleece or felt fabric (14).

9. The ironing table according to claim 8, characterised in that the sheet (13) of cellular material has a surface density ranging between 18 g/m$^2$ and 45 g/m$^2$, with a thickness between 1.5 and 2.5 mm, if used in combination with another flexible insulating element and a surface density ranging between 50 g/m$^2$ and 250 g/m$^2$, with a thickness between 5 mm and 10 mm, if used in isolation to form the flexible insulating element.

10. The ironing table according to claim 7, characterised in that the flexible insulating element (13; 14; 13,14) comprises at least one layer (13) of cellular material or foam and at least one fleece or felt fabric (14), the layer (13) of cellular material or foam being arranged on the side of the outer covering (12).

11. The ironing table according to claim 10, characterised in that the layer (13) of cellular material or foam is in contact with the lower face of the outer covering (12).

12. The ironing table according to claim 7, characterised in that the outer covering (12), the layer (13) of cellular material or foam and the fleece (14) or felt are joined together by calendering, after singeing of the layer (13) of cellular material to soften it and thus allow the three elements to be joined after calendering, so as to form a single element forming a cover (21).

13. An ironing assembly comprising an ironing table according to claim 1 and a steam-type ironing device (20).

14. An assembly comprising an ironing table and a cover for covering the ironing table, the cover comprising, in succession, a textile covering, a sheet of cellular material or foam, and a fleece or felt fabric, wherein said textile covering, said sheet of cellular material or foam, and said fleece or felt fabric are joined together to cover a board of the ironing table, with a film of plastics material being trapped between the cover and the board.

15. A manufacturing process for a cover intended to cover an ironing table according to claim 1, comprising steps in which:

a width or strip of a textile fabric is unrolled from a roll of said textile fabric;

a strip or width of a lap of cellular material or foam is unrolled from a roll of said lap of cellular material or foam, the strip or width being identical to the strip or width of the textile fabric;

a strip or width of a fleece or felt fabric is unrolled from a roll of said fleece or felt fabric, the strip or width being identical to the strip or width of the textile fabric and the lap of cellular material;

the lap of cellular material is softened, a stack of three strips or widths together is passed, with the softened lap arranged between the textile fabric and the fleece or felt, between two pressing elements for calendering thereof and to achieve joining in the form of a laminate of the same strip or width comprising the textile fabric, the lap of cellular material and the fleece or felt.

16. The assembly of claim 14, wherein said textile covering, sheet of cellular material or foam, and fleece or felt fabric are joined together by calendering.

17. The assembly of claim 14, wherein said film of plastics material is a bubble film.

18. A cover for an ironing table comprising in succession, a textile covering, a sheet of cellular material or foam, and a fleece or felt fabric, wherein said textile covering, sheet of cellular material or foam, and fleece or felt fabric being joined together by calendering.

* * * * *